US005883315A

United States Patent [19]

Kaplan et al.

[11] Patent Number: 5,883,315

[45] Date of Patent: Mar. 16, 1999

[54] STRINGED INSTRUMENT SHOULDER REST

[75] Inventors: Burton Kaplan, 817 West End Ave., #11B, New York, N.Y. 10025; Harry Coss, Arlington, Va.

[73] Assignee: Burton Kaplan, New York, N.Y.

[21] Appl. No.: 857,293

[22] Filed: May 16, 1997

[51] Int. Cl.[6] ..... G10D 1/02

[52] U.S. Cl. ..... 84/279; 84/270; 84/278

[58] Field of Search ..... 84/279, 280, 281, 84/270, 278

[56] References Cited

U.S. PATENT DOCUMENTS 1,416,644 5/1922 Jordan ..... 84/278

3,727,509 4/1973 Henkle ..... 84/278

4,951,541 8/1990 McMillan ..... 84/280

5,507,213 4/1996 Beseke ..... 84/280

*Primary Examiner*—William M. Shoop, Jr.

*Assistant Examiner*—Shih-yung Hsieh

*Attorney, Agent, or Firm*—Hoffmann & Baron, LLP

[57] ABSTRACT

A shoulder rest for use with a stringed musical instrument, such as a violin or viola, includes a substantially rigid body, defining a hollow resonating chamber, and supporting feet mounted to the body for engaging the underside of the instrument and spacing the body from the instrument when the shoulder rest is attached thereon. A fastener is provided for removably attaching the shoulder rest to the underside of the instrument.

15 Claims, 6 Drawing Sheets

STRINGED INSTRUMENT SHOULDER REST

BACKGROUND OF THE INVENTION

1. Field of the Invention

The present invention relates generally to supports for stringed musical instruments, and more particularly relates to a shoulder rest for use with a stringed musical instrument of the violin or viola type, of conventional size and construction.

2. Description of the Prior Art

The use of shoulder rests to comfortably support a stringed musical instrument such as a violin or viola is well-known in the prior art. In its simplest form, the shoulder rest is merely a pillow-like apparatus that provides a layer of cushioning between the musician's shoulder and the hard underside surface of the instrument's resonance box, thereby absorbing the force of the musician who bears down on the instrument while it is being played. In fact, some prior art shoulder rests have actually employed air bags.

There have been several deficiencies encountered with prior art violin or viola shoulder rests, among which include the inability to effectively position the shoulder rest to accommodate musicians of varying physical characteristics and playing preferences, thus compromising comfort. Moreover, and equally significant, many prior art shoulder rests generally contacted a substantial portion of the instrument's underside surface in such a manner as to partially absorb and muffle the violin sound, thereby adversely affecting the resonance and overall tonal quality of the instrument.

Another important deficiency encountered by some prior art shoulder rests has been their tendency to skid along the underside surface of the instrument's resonance box while the musician was performing, necessitating frequent readjustment of the shoulder rest. Some prior art shoulder rests have employed rubber coated metal support members which clamped the shoulder rest to the instrument, thus preventing the instrument from sliding in relation to the shoulder rest. Unfortunately, clamped rests are undesirable because the clamping action produces pressure on the back of the violin which dampens the sound. To alleviate the problem of sliding, a large contact area would ideally be required to engage the shoulder rest with the instrument's underside surface, in order to provide enough friction between the two surfaces to prevent sliding. This directly conflicts with the objective of eliminating the adverse sound-dampening effects, described previously, which theoretically necessitates an infinitely small point of contact between the shoulder rest and the violin's resonance box.

Some prior art shoulder rests have attempted to strike a compromise between these competing ideals. For example, U.S. Pat. No. 5,507,213, which was issued to Tamsen Beseke, discloses a shoulder rest for use with a violin or viola that is made of a solid piece of elastic foam material containing regions of depressions and elevations, with the elevated regions engaging against the backside of the instrument, thereby reducing the amount of contact between the shoulder rest and the instrument. Similarly, U.S. Pat. No. 4,951,541, which was issued to Steven W. McMillan, discloses a shoulder rest containing a substantially horseshoe-shaped depression tending to disengage the supporting base of the shoulder rest from the violin's underside surface, except around the device's periphery. These prior art shoulder rests have been unsuccessful, however, at providing any significant enhancements in tonal quality.

OBJECTS AND SUMMARY OF THE INVENTION

It is an object of the present invention to provide a shoulder rest for use with a stringed musical instrument, such as a violin or viola, which does not noticeably interfere with the proper resonance of the instrument, and enhances the instrument's overall tonal quality.

It is another object of the present invention to provide a violin (or viola) shoulder rest having an adjustable means of attachment to the underside surface of the instrument, thereby allowing the musician to quickly and comfortably position the shoulder rest to accommodate his or her physical size and unique playing style.

It is yet another object of the present invention to provide a supporting device for a stringed instrument which will securely grip the instrument, thereby preventing the instrument from slipping on the shoulder as it is being played, and which will not mar or otherwise damage the instrument's surface.

It is a further object of the present invention to provide a supporting device for a stringed instrument, which because of its size and ease of attachment, can easily be removed and carried along in the storage compartment of the instrument case.

It is still a further object of the present invention to provide a shoulder rest which is inexpensive to manufacture and efficient in its operation and repair.

In accordance with one form of the present invention, there is provided a shoulder rest for use with a stringed musical instrument, such as a violin or viola, that incorporates a hollow body which is open at opposite ends, forming a sound resonating chamber which enhances the tonal quality of the instrument.

The shoulder rest further provides at least three hemispherical supporting grommets or feet, preferably composed of a hard rubber material, located on the top surface of the shoulder rest body. The feet engage the backside of the instrument's resonance box without marring the surface of the instrument, while still preventing the violin from skidding off the musician's shoulder as the instrument is being played.

The shoulder rest also preferably includes a layer of padding located on the bottom surface of the shoulder rest body, preferably made from a compressible, foam rubber material, which cushions the musician's shoulder from the force of the musician who bears down on the instrument while playing, and provides adhesion between the musician's shoulder and the instrument so that it does not slide easily.

A preferred form of the shoulder rest, as well as other embodiments, objects, features and advantages of this invention, will be apparent from the following detailed description of illustrative embodiments thereof, which is to be read in connection with the accompanying drawings.

DETAILED DESCRIPTION OF THE PREFERRED EMBODIMENTS

Figure 1A:
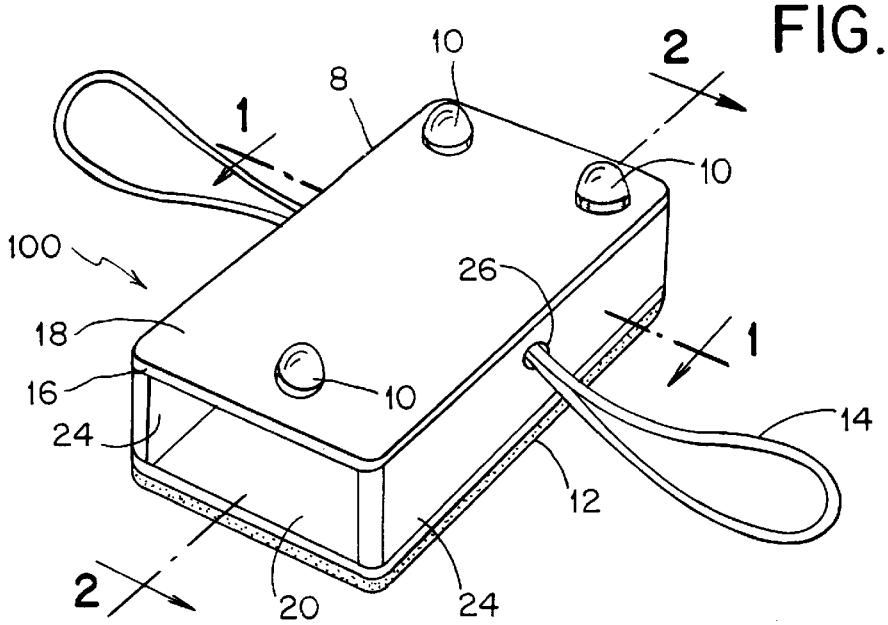
FIG. 1A is a perspective view of the top surface of a shoulder rest formed in accordance with one form of the present invention.
Figure 1B:
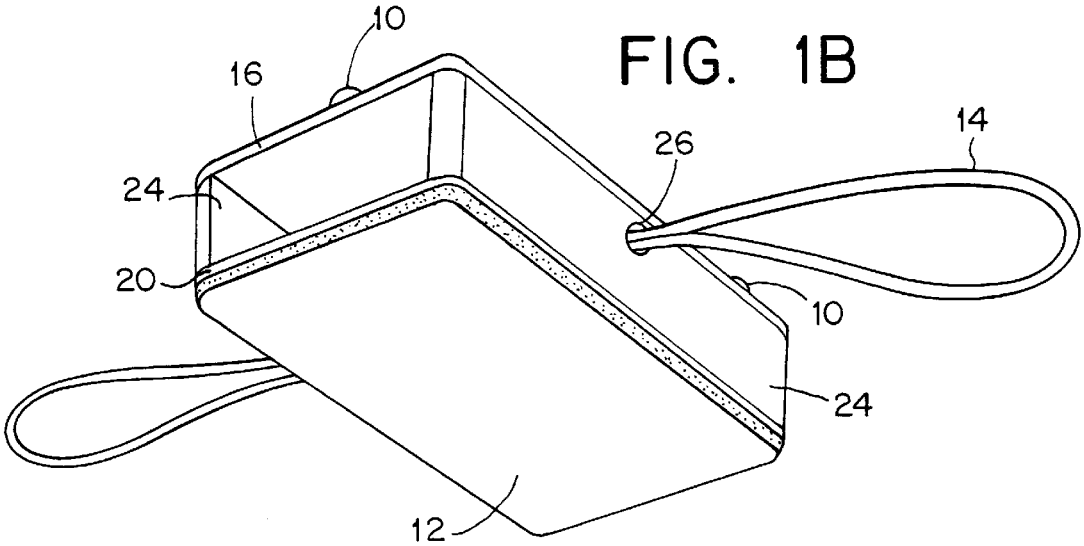
FIG. 1B is a perspective view of the bottom surface of the shoulder rest shown in FIG. 1A.
Figure 1C:
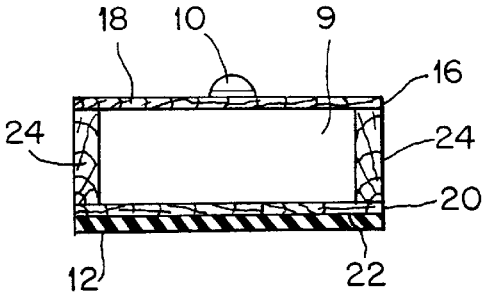
FIG. 1C is a cross-sectional view of the shoulder rest shown in FIGS. 1A and 1B, taken along line 1—1 of FIG. 1A.
Figure 1D:
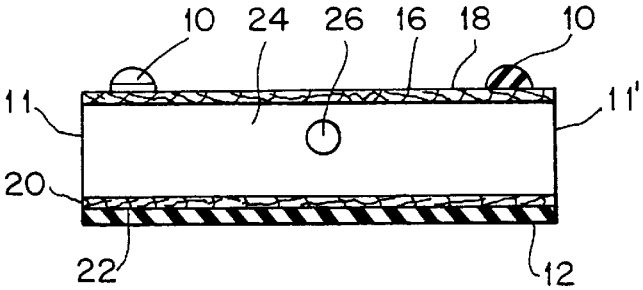
FIG. 1D is a cross-sectional view of the shoulder rest shown in FIGS. 1A and 1B, taken along line 2—2 of FIG. 1A.

Initially referring to FIGS. 1A–1D of the drawings, a shoulder rest 100 constructed in accordance with the present invention basically includes four distinct elements: a body 8, supporting members or feet 10 attached to the body 8, preferably a layer of padding 12 mounted on the body 8, and an elastic band 14 or similar means for movably attaching the shoulder rest 100 to the underside of the instrument.

More specifically, the body 8 of the shoulder rest 100 defines a resonating chamber 9 which is open at laterally opposed ends 11 and 11'. The body 8 has a top wall 16 with a corresponding top surface 18, a bottom wall 20 disposed opposite the top wall 16 and having a corresponding bottom surface 22, and opposite side walls 24 that are substantially parallel to each other and orthogonal to the top and bottom walls. Furthermore, each side wall 24 of the shoulder rest body 8 preferably has a slit or hole 26 formed through the thickness thereof through which the elastic band 14 or similar attachment means passes. In the embodiment shown in FIGS. 1A–1D and described above, the preferred axial length of the shoulder rest 100 for a violin is about 3¼ inches and the lateral width is about 1¾ inches. For a viola, which may vary considerably in size, the shoulder rest will preferably also vary in size proportionally.

An important feature of the shoulder rest of the present invention is its ability to not only comfortably support the instrument on the musician's shoulder, but additionally to resonate with the instrument. More specifically, as the violin or viola is played, sound vibrations from the instrument are transferred from the underside of the instrument's resonance box, through the shoulder rest supporting feet 10, which are in direct contact with the violin or viola, to the hollow resonating body chamber 9 of the shoulder rest. The body 8 subsequently resonates with the instrument, channeling the sound out through the open ends 11 and 11' of the body 8. This feature allows the shoulder rest 100 to amplify the instrument's sound and enhance the tonal quality thereof, in much the same way that a violin bridge transfers the vibrations of the strings to the violin's resonance box to obtain its rich sound.

Because every structure attached to the violin's resonance box may affect the frequency of resonance and because the shoulder rest 100 must necessarily contact the instrument, the particular materials with which the shoulder rest is manufactured changes the overall tonal quality of the instrument. The body walls 16, 20 and 24 can be composed of any rigid material, such as plastic, fiberglass, Delrin™ and Nylon™, but it is preferable that the walls be made of wood, especially a hard wood such as maple. The thickness of the top and bottom walls 16 and 20, and the side walls 24, is preferably between about 1/16 inch and about ⅛ inch.

The supporting feet 10 are preferably formed of hard rubber, although materials other than hard rubber may be used, for example, silicone rubber or foam rubber, as long as it prevents the instrument from sliding off the musician's shoulder and does not mar the surface of the instrument. It has been observed, through experimentation, that supporting feet 10 formed of a hard material yields a more desirable musical tone, and is therefore preferred. Moreover, the supporting feet 10 are preferably shaped as hemispheres, although other shapes, for example squares or trapezoids, may be used.

The pad 12 is formed as a thin layer, preferably about ⅛ inch in thickness, of an open-cell, foam rubber material. The pad 12 may be thicker for increased comfort; however, a thicker pad will not affect the enhanced resonance of the shoulder rest. The pad 12 is preferably adhesively attached to the bottom surface 22 of the bottom wall 20 of the body 8. The purpose of the pad 12 is to provide a layer of cushioning between the musician's shoulder and the bottom surface 22 of the shoulder rest body 8.

Figure 2:
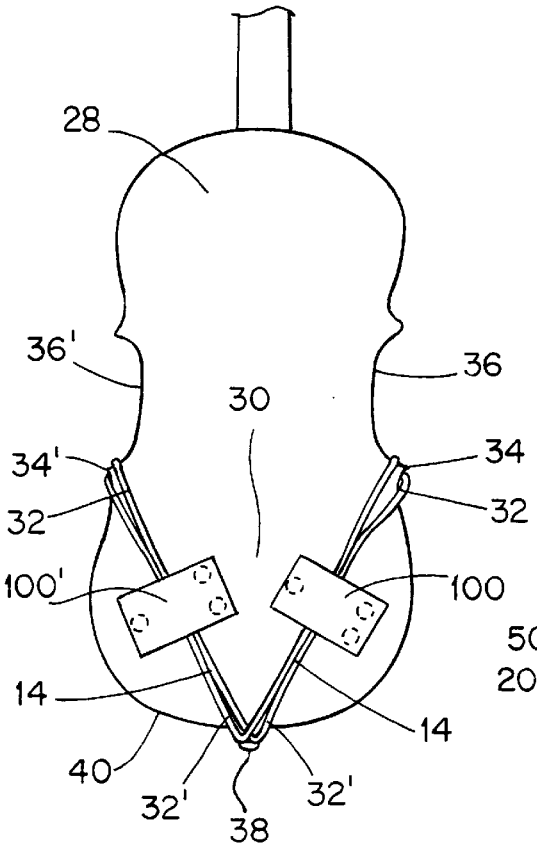
FIG. 2 is an underside view of a stringed instrument illustrating the preferred mounting and placement of the shoulder rests shown in FIGS. 1A–1D on the instrument.

Referring to FIG. 2, one preferred method for mounting the shoulder rests 100 and 100' of the present invention to the instrument is illustrated. The shoulder rest 100 of FIGS. 1A–1D is designed to be mounted, preferably in pairs, on the underside 28 of the resonance box 30 of a bowed stringed instrument, such as a violin or viola, of conventional or standard size and construction. Each shoulder rest 100 and 100' has an elastic band 14 which passes through holes 26 in the side walls 24 of the shoulder rest body 8 and forms loops 32 and 32' at laterally opposed ends of the elastic band 14, as described previously. The first shoulder rest 100 is mounted so that the supporting feet 10, located on the top surface 18 of the shoulder rest body 8, contact the underside surface 28 of the violin or viola by stretching the elastic band 14 such that one end 32 loops around the lower corner 34 of a C-shaped constriction or bout 36 of the violin or viola and the opposite end 32' of the elastic band 14 loops around the anchor peg or button 38 of the instrument. The second shoulder rest 100', if used, is mounted in the same fashion, except that the elastic band 14 is connected between the anchor button 38 and the lower corner 34' of a C-shaped bout 36' on the opposite side of the instrument.

The position of the shoulder rest supporting feet 10 on the underside 28 of the instrument affects the tonal characteristics of the instrument. Referring to FIG. 2, the shoulder rest 100' on the "E" string side of the instrument (left side in FIG. 2) is shown with its supporting feet 10 arranged such that the end of the body 8 having two supporting feet 10 is nearer to the center of the instrument and the end of the body 8 having one supporting foot 10 is positioned nearer to the lower rim 40 of the resonance box 30 of the instrument. Conversely, the shoulder rest 100 on the "G" string side of the instrument (right side in FIG. 2) is placed with the end of the body 8 having two supporting feet 10 nearer to the lower rim 40 of the resonance box 30 of the instrument and the end of the body 8 having a single supporting foot 10 is placed nearer to the center of the instrument. This configuration provides the most desirable sound and is therefore preferred. However, other orientations of the shoulder rests 100, 100' are possible and may be even more preferred, depending upon the particular tonal characteristics of the instrument on which the shoulder rests are situated, including using one instead of two rests. Furthermore, each shoulder rest 100 and 100' may freely slide along its elastic band 14, allowing the musician to adjust the position of the shoulder rests 100 and 100' on the underside 28 of the violin or viola, between the anchor button 38 and a lower comer 34 or 34' of a bout 36 or 36' of the instrument, to provide optimum comfort and tonal quality.

Figure 7:
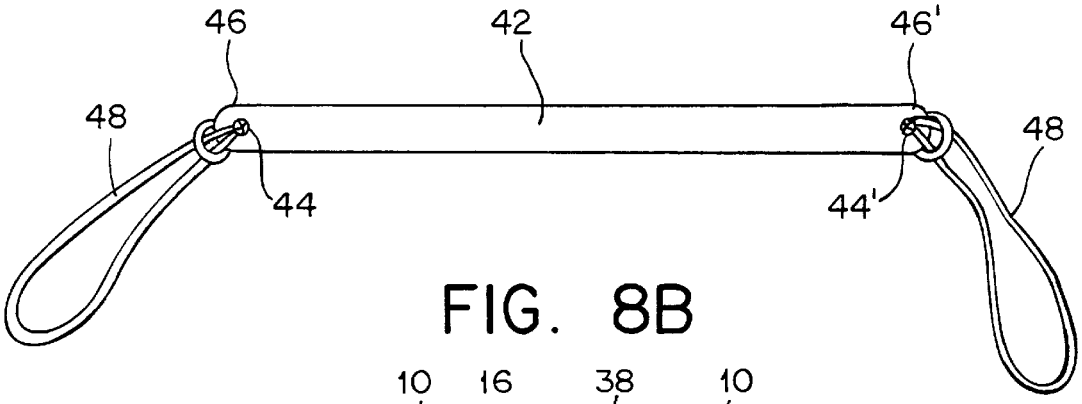
FIG. 7 is a top view of a preferred elastic strap formed in accordance with the present invention and used to attach the shoulder rests to the instrument.

The attachment method shown in FIG. 2 employs an elastic band 14 having loops 32 and 32' at laterally opposed ends. The present invention, however, also contemplates an elastic band or strap having only one loop, with the opposite end possessing a hole or slit, similar to a button hole, which can be slipped over the anchor button 38 of the instrument. Additionally, it is not necessary that the entire length of the band be elastic. In fact, referring to FIG. 7, it is preferred that the band 42 be composed primarily of a relatively non-elastic material, such as leather or vinyl plastic, having a hole 44 or 44' at each laterally opposed end 46 and 46', through which an elastic band 48 is passed to form a "slip knot" or other arrangement to keep the elastic band 48 from slipping through the hole 44 or 44'. The shoulder rest is subsequently attached using the band 42 in the same manner as previously described and illustrated in FIG. 2.

Another embodiment of the present invention is illustrated in FIGS. 3A–3D. Referring to FIGS. 3A–3D, this embodiment is primarily the same as the above-described embodiment of FIGS. 1A–1D, with the exception that one open end 50 of the shoulder rest body 52 is flared, formed by portions of the sidewalls 54 and 54' which mutually diverge. It is preferable that the side walls 56 and 56' remain essentially parallel to each other, as in the embodiment of FIGS. 1A–1D, for a substantial portion of the shoulder rest body 52, thus defining a rectangular portion, except for the final approximately 1 inch, at which point the side walls 54 and 54' of the body 52 mutually diverge to form a flared open end 50. The angles at which the side walls 54 and 54' diverge are not absolutely critical. In this embodiment, the preferred axial length of the flared shoulder rest 200 is about 3½ inches and the lateral width should start from about 1¾ inches along the longitudinal axis, gradually increasing to about 2¼ inches only over the final 1 inch of the shoulder rest's axial length. The preferred vertical height of the flared shoulder rest 200 is about 1 inch, including the supporting feet 10 and padding layer 12. In another preferred embodiment, the flared portion starts midlength on the shoulder rest so that the flared and unflared portions of the shoulder rest body 52 are approximately equal in length.

This flared end 50 has the important feature of outwardly projecting sound vibrations emanating from the resonating chamber 9 of the shoulder rest 200, thus providing a more desirable sound. Referring to FIGS. 3A–3D, although a flared end 50 with a straight edge is also contemplated by this embodiment, it is preferred that the flared end 50 of the shoulder rest 200 have a slightly curved edge which approximates the curvature of the lower rim 40 of the instrument's resonance box 30. This design has the benefit of allowing the shoulder rest 200 to be positioned with its flared end 50 closer to the edge of the instrument.

Figure 3C:
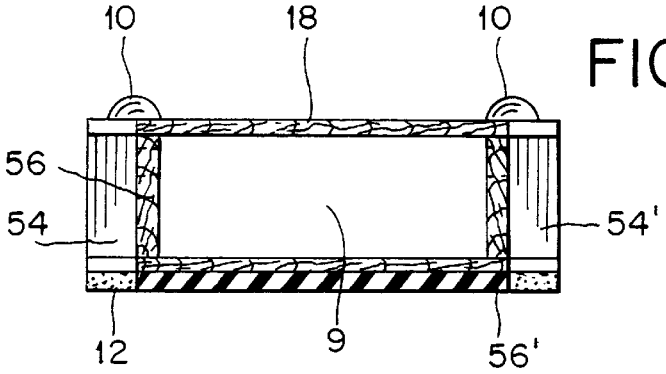
FIG. 3C is a cross-sectional view of the shoulder rest shown in FIGS. 3A and 3B, taken along line 3—3 of FIG. 3A.
Figure 3D:
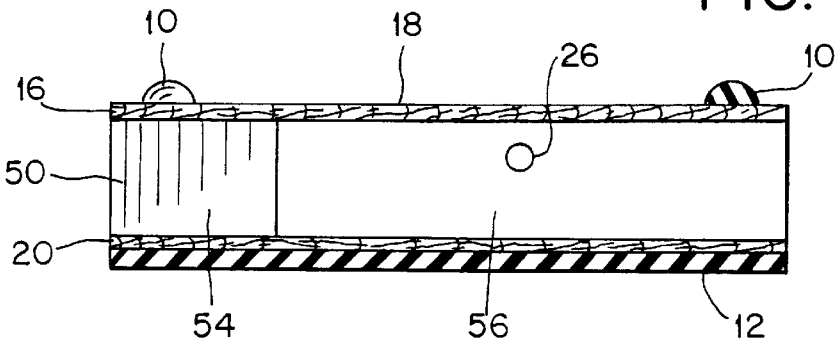
FIG. 3D is a cross-sectional view of the shoulder rest shown in FIGS. 3A and 3B, taken along line 4—4 of FIG. 3A.
Figure 3A:
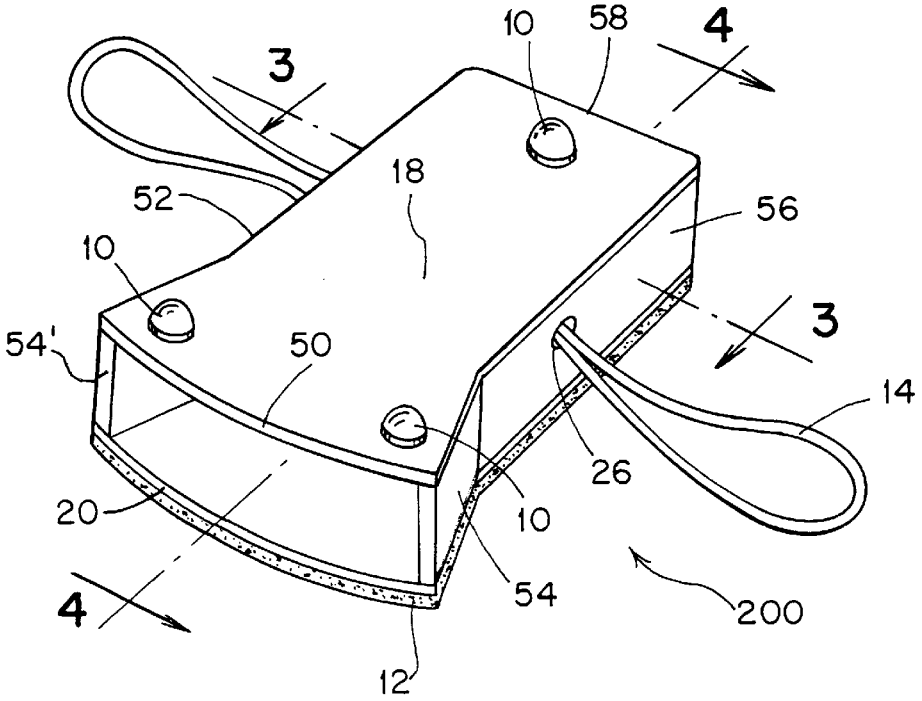
FIG. 3A is a perspective view of the top surface of a second embodiment of the shoulder rest formed in accordance with the present invention.
Figure 3B:
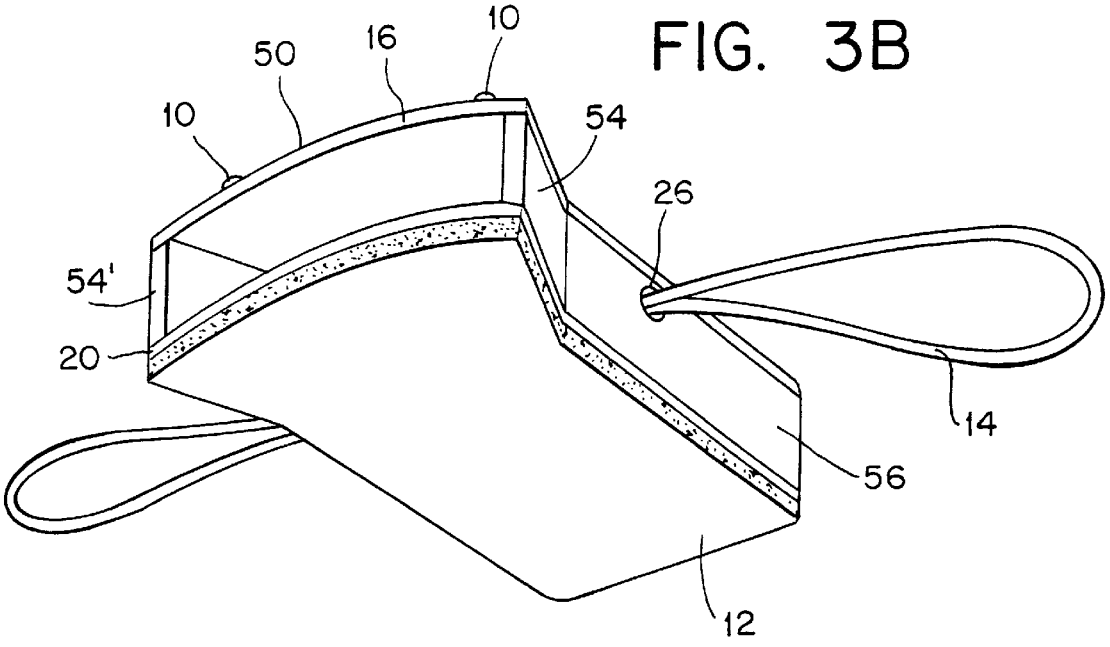
FIG. 3B is a perspective view of the bottom surface of the shoulder rest shown in FIG. 3A.
Figure 5A:
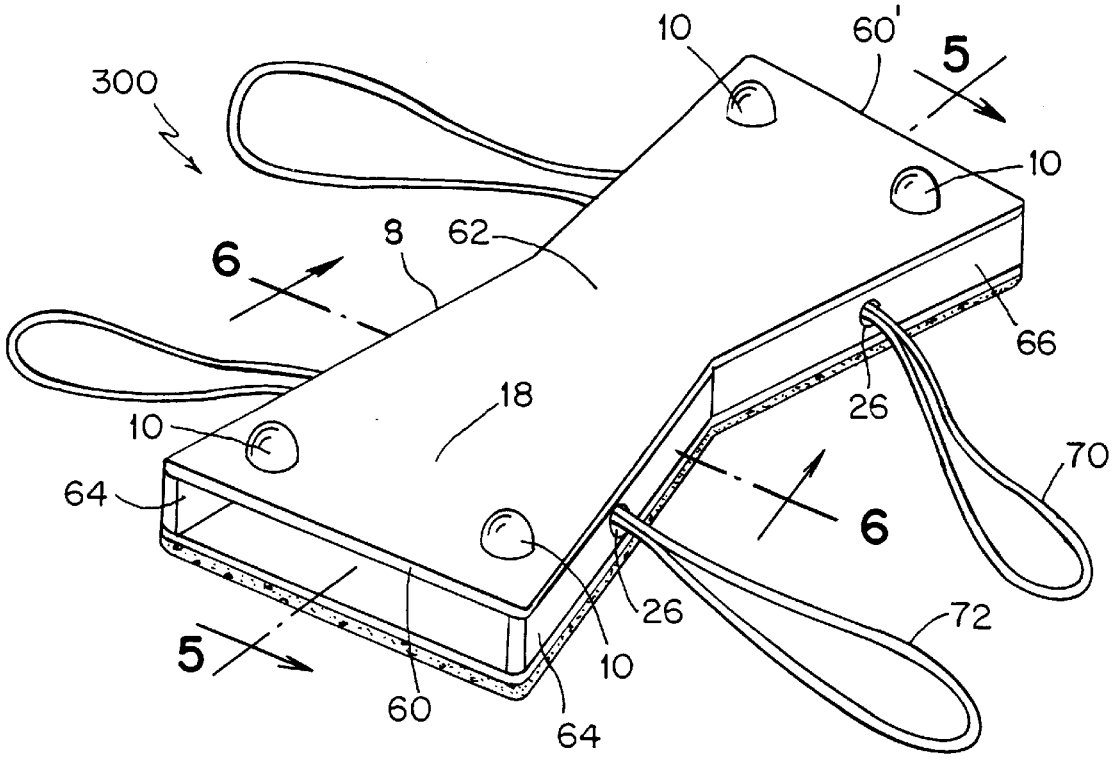
FIG. 5A is a perspective view of the top surface of a third embodiment of a shoulder rest formed in accordance with the present invention.
Figure 5B:
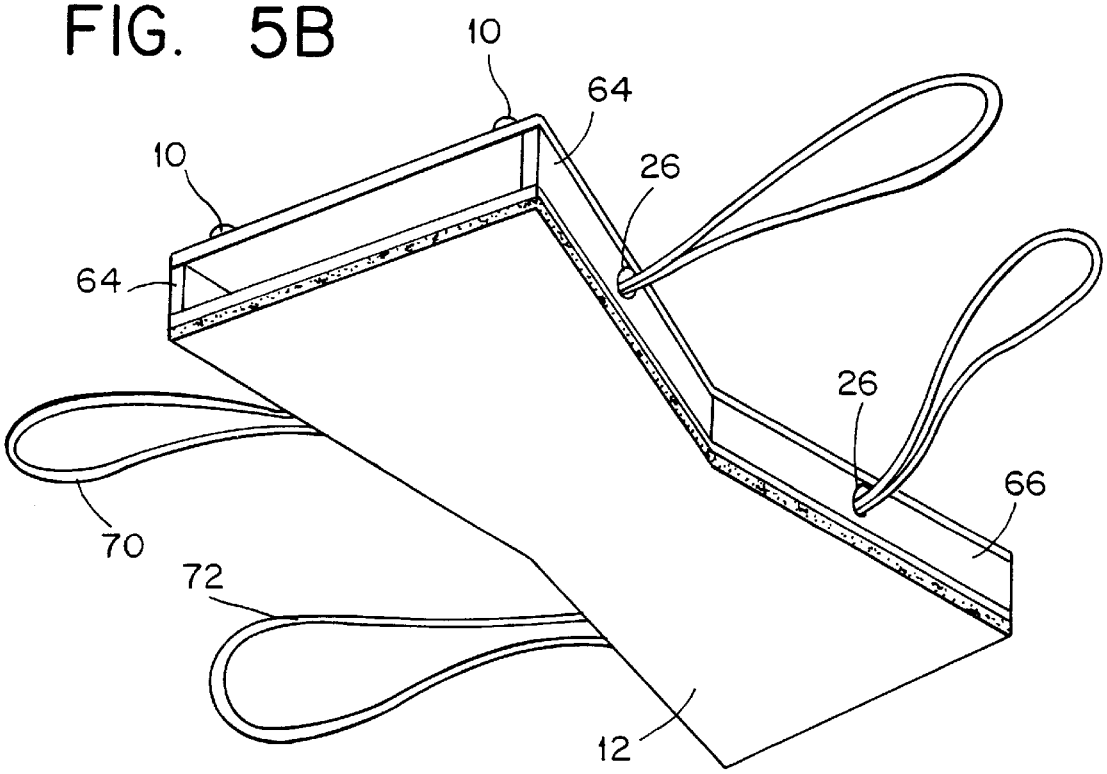
FIG. 5B is a perspective view of the bottom surface of the shoulder rest shown in FIG. 5A.
Figure 5C:
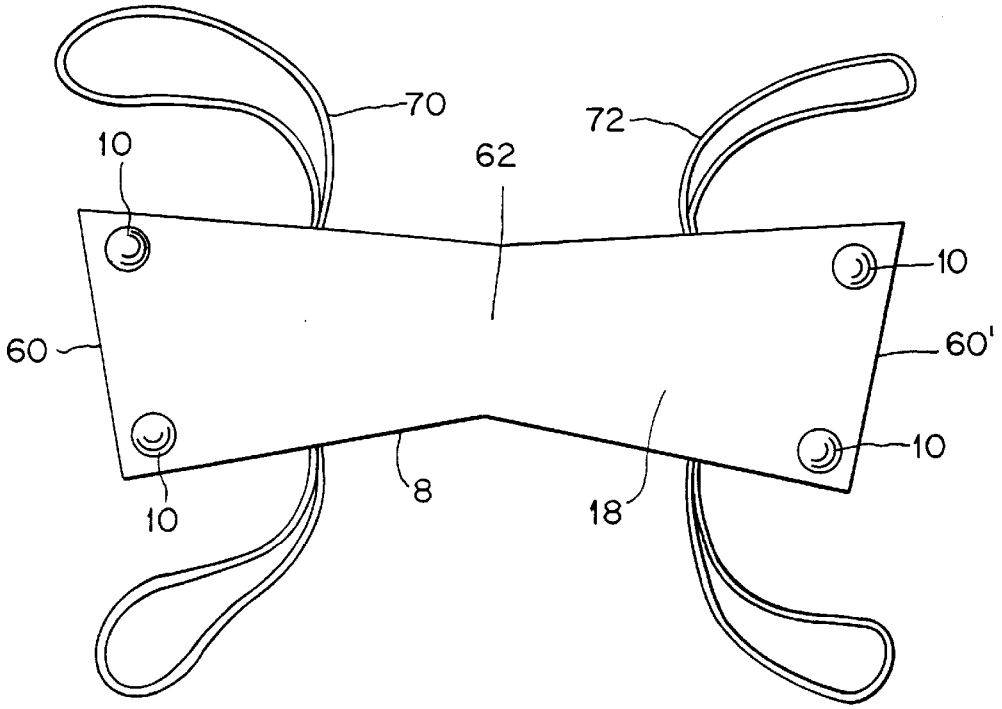
FIG. 5C is a top view of the shoulder rest shown in FIG. 5A.
Figure 5D:
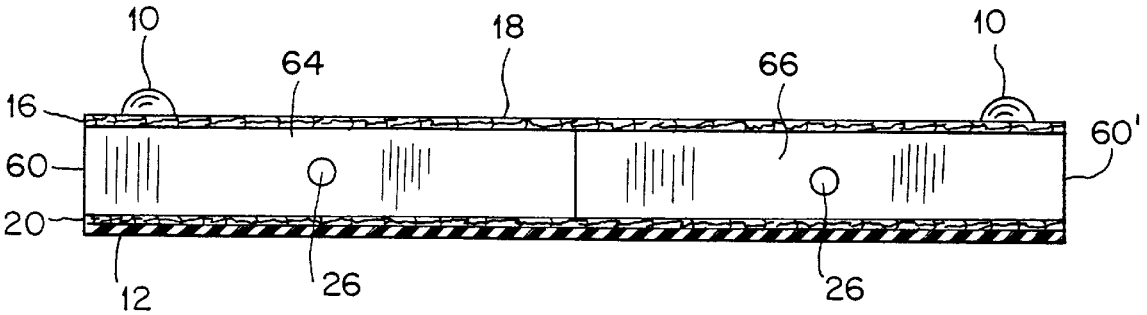
FIG. 5D is a cross-sectional view of the shoulder rest shown in FIGS. 5A–5C, taken along line 5—5 of FIG. 5A.
Figure 5E:
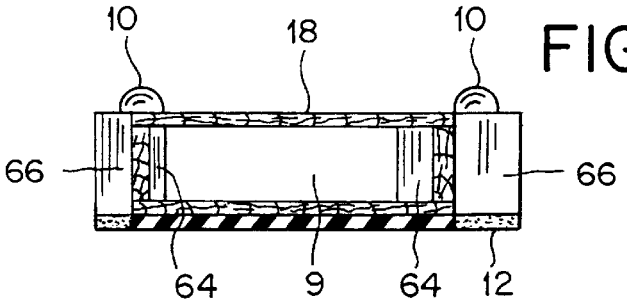
FIG. 5E is a cross-sectional view of the shoulder rest shown in FIGS. 5A–5C, taken along line 6—6 of FIG. 5A.

The preferred placement of the supporting feet 10 on the top surface 18 of the flared shoulder rest body 52 is illustrated in FIG. 3A. For stability purposes, the wider, flared open end 50 of the top surface 18 of the shoulder rest body 52 has two supporting feet 10, spaced at opposite comers of the flared end 50, while the third supporting foot 10 is centrally positioned along the narrower end 58 of the top surface 18 of the shoulder rest body 52.

Figure 4:
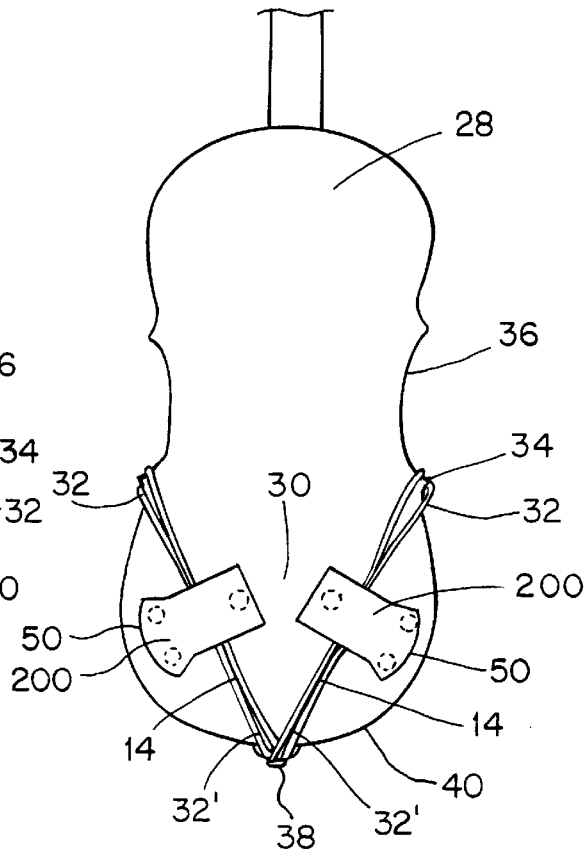
FIG. 4 is an underside view of a stringed instrument illustrating the preferred mounting and placement of the shoulder rest shown in FIGS. 3A–3D.

FIG. 4 illustrates the preferred method of attaching the flared shoulder rest embodiment 200 of FIGS. 3A–3D to the instrument. Referring to FIG. 4, the preferred mounting configuration employs two flared shoulder rests 200, similar to the previously described embodiment of FIGS. 1A–1D. The flared end 50 of the shoulder rest 200 preferably faces toward the outer rim 40 of the instrument's resonance box 30 and the shoulder rests 200 are attached to the instrument in the same fashion as previously described and illustrated in FIG. 2, specifically, by looping one end 32 of the elastic band 14 about a lower comer 34 of a bout 36 and looping the other end 32' of the elastic band 14 about the anchor button 38 of the instrument.

Yet another embodiment of the present invention is illustrated in FIGS. 5A–5E. In this embodiment, both open ends 60 and 60' of the shoulder rest body 8 forming the resonating chamber 9 are flared and abut one another, thereby forming a "bow tie" configuration. Specifically, the body 8 of the "bow tie" shoulder rest 300 comprises a narrower central portion 62 from which two pairs of mutually diverging side walls 64 and 66 emanate in opposite directions, with each pair of diverging side walls 64 and 66 forming wider flared open ends 60 and 60'. The angles at which the side walls 64 and 66 diverge are not absolutely critical, nor are they required to be symmetrical. In this embodiment, the preferred axial length of the body is about 7 inches and the lateral width of the body should start from about ¼ inches along the longitudinal axis at the center portion 62 of the body, gradually increasing to about 3½ inches at each flared open end 60 and 60' of the "bow tie" shoulder rest body 8. Furthermore, each side wall 64 or 66 has a slit or hole 26 formed through its thickness, through which the elastic attachment bands 70 and 72 pass.

This "bow tie" embodiment 300 further differs from the above-described embodiments of FIGS. 1A–1D and FIGS. 3A–3D in that the top surface 18 of the "bow tie" shoulder rest body 8 preferably has four supporting feet 10, spaced at each comer of the flared ends 60 and 60', with which to engage the underside surface 28 of the instrument, rather than three supporting feet 10. Because of the larger size and shape of this embodiment, it was preferable to use four supporting feet 10 in order to provide ample stability for the shoulder rest 300.

Figure 6:
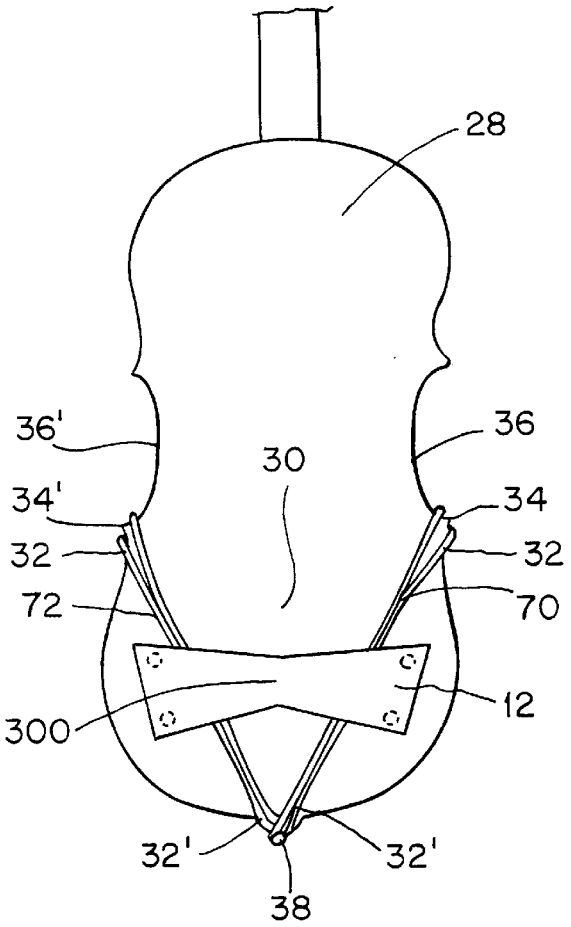
FIG. 6 is an underside view of a stringed instrument illustrating the preferred mounting and placement of the shoulder rest shown in FIGS. 5A–5E on the instrument.

FIG. 6 illustrates the preferred method for mounting the embodiment of the shoulder rest 300, shown in FIGS. 5A–5E, to the underside 28 of the resonance box 30 of the instrument. Referring to FIG. 6, this embodiment uses two elastic bands 70 and 72, similar to the elastic bands previously described, and are attached between the same points on the instrument as previously described and shown in FIG. 2 and FIG. 4. Specifically, one elastic band 70 passes through holes 26 in the first pair of mutually diverging side walls 66 and is attached between the anchor button 38 of the instrument at one end 32 of the elastic band 70 and a lower corner 34 of a bout 36 of the instrument at the opposite end 32' of the band 70. Similarly, the second elastic band 72 passes through holes 26 in the second pair of mutually diverging side walls 64 and is attached between the anchor button 38 of the instrument and a lower comer 34' of a bout 36' on the opposite side of the instrument. As an alternate method of attaching the "bow tie" shoulder rest 300 to the instrument, the elastic bands 70 and 72 may simply pass over the padded surface 12 of the shoulder rest 300, rather than passing through the holes 26 in the side walls 64 and 66 of the shoulder rest body 8, and in such case, the side wall holes 26 may be omitted. Each of the other embodiments of the shoulder rest described herein may be attached in a similar manner, i.e., by having its elastic band stretch over the rest body rather then passing through the shoulder rest, so that the side wall holes 26 may be omitted.

Figure 8A:
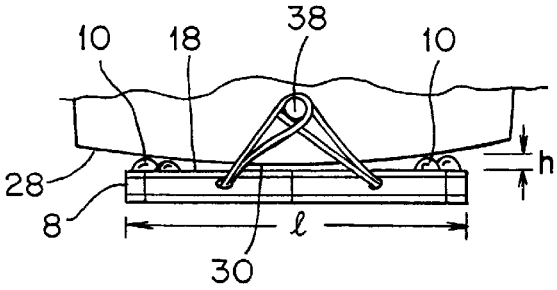
FIG. 8A is an end view of a stringed instrument with a shoulder rest mounted thereon, illustrating the determination of the minimum height for the supporting feet of the shoulder rest.

Referring to FIG. 8A, although the dimensions of the supporting feet 10 are not absolutely critical, the vertical height of the supporting feet 10 must be such that enough clearance, h, is provided between the underside surface 28 of the instrument's resonance box 30 and the top surface 18 of the shoulder rest body 8, taking into account the curvature or arch of the resonance box 30. Because the "bow tie" shoulder rest 300 has a longer axial length, 1, and therefore spans a greater distance on the curved resonance box 30 of the instrument than the two smaller embodiments depicted in FIGS. 1A–1D and FIGS. 3A–3D, the supporting feet 10 of the "bow tie" shoulder rest 300 must correspondingly have a greater vertical height than the supporting feet 10 used on the other smaller embodiments.

Figure 8B:
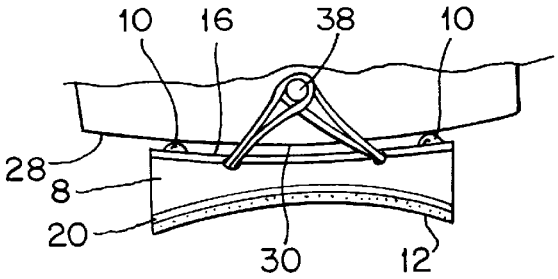
FIG. 8B is an end view of a stringed instrument with a shoulder rest having a concave top surface mounted thereon.

An alternative embodiment, therefore, is to use a top wall 16 for the body 8 which is not planar, but rather concave, as shown in FIG. 8B. The rest may be positioned on the violin such that its curved top wall 16 bridges the arch 30 in the underside of the violin. With this construction, smaller supporting feet 10 may be used, as the rest may now be supported closer to the underside surface of the violin. The curved top wall 16 may be employed on all of the embodiments of the invention described herein, but, of course, has practical application with a larger "bow tie" shoulder rest 300 shown in FIGS. 5A–5E. If desired, the padded bottom wall 20 of any one of the rests may likewise be bowed inwardly, to form a comfortable depression or arch for the musician's shoulder, or outwardly.

Dimensionally, the body 8 of any one of the shoulder rests may be constructed using a rectangular cross-section of nearly any proportion, limited only by the size of the instrument upon which the shoulder rest is mounted and the physical size of the musician. The maximum axial length and lateral width of the shoulder rest body 8 is limited by the proximity, on the underside of the violin or viola, of the two shoulder rests to each other, assuming two rests are used. It is important that the dimensions of the rests be such that the two rests do not contact each other, or there will be a degradation in tonal quality. The shoulder rests, however, do not need to be identical in size. In other words, two shoulder rests of differing size may be employed. For example, a musician may wish to accentuate one band of frequencies over another, thus compensating for the tonal deficiencies inherent in a particular instrument. In this situation, if one rest is made shorter in length, the second rest may be made longer, thereby avoiding contact between the two shoulder rests. Although contact between shoulder rests is not a concern when using the larger "bow tie" embodiment 300, since only one shoulder rest is used, the length and width dimensions of the "bow tie" shoulder rest body 8 will be limited by the size of the instrument on which it is mounted. However, it is preferred if the "bow tie" shoulder rest 300 has a length such that its supporting feet 10 engage the back of the stringed instrument as close as possible to the edge of the instrument. Furthermore, there is a minimum dimension for the shoulder rest body 8 at which point only slight tonal enhancement can be discerned. This minimum dimension will, of course, be dependent upon the type of materials used in the manufacture of the shoulder rest as well as the musician's own subjective tonal preferences.

The maximum vertical height of any one of the shoulder rests is not absolutely critical and is limited by the spacing between the musician's neck and shoulder. It is preferred that the shoulder rest have a vertical dimension of about ¾ inch to about 1 inch, including the height of the supporting feet 10 and padding layer 12. This height has been found to comfortably accommodate most musicians. The shoulder rest body and/or padding may be increased or decreased in thickness to accommodate musicians with different neck dimensions.

In comparing the preferred embodiments, it may be noted that a different number of supporting feet 10 are used on certain versions. Through experimentation, it was observed that fewer points of contact with the violin's surface provide the most desirable tone. In addition, it was noted that fewer feet 10 contacting the stringed instrument actually clarified the articulation of fingers and improves the speed of response of the string to the bow. Therefore, although the present invention contemplates using more than three supporting feet 10, three points of contact with the underside 28 of the instrument, preferably arranged in a triangular configuration, represent the preferred minimum number of the discrete-type supporting feet 10 shown in the figures and described previously, necessary for the shoulder rest to be stable, without marring the violin's surface (a less desirable, but possible, alternative would be to have two supporting feet 10, with stability being provided when the musician positions the instrument for playing). Three supporting feet 10 work well for the shoulder rest embodiments 100 and 200 shown in FIGS. 1A–1D and FIGS. 3A–3D. However, because of the larger size and shape of the embodiment 300 shown in FIGS. 5A–5E, four supporting feet 10, located in opposite corners of the top surface 18 of the shoulder rest body 8, are preferred in order for the shoulder rest 300 to be stable on the underside 28 of the instrument, although three feet may be used with the "bow tie" shoulder rest and, such a rest having three feet may be oriented so that the single foot is on the "G" string side or "E" string side to enhance either the treble or bass quality.

Although not preferred, it is possible to construct the supporting feet as lengthwise elongated feet (not shown) which extend at least partially across the width of the top surface 18 of the shoulder rest body 8, one foot preferably positioned near each axial end of the shoulder rest body 8, as long as such feet do not dampen or adversely affect the sound emanating from the stringed instrument and the resonance chamber 9 of the shoulder rest.

It is preferred that the top wall 16, bottom wall 20 and side walls 24, 54 and 56, or 64 and 66 (depending on the embodiment used) forming the body 8 of any one of the shoulder rests be joined using glue or a similar means of attachment, such as thermal bonding, without the use of mechanical attachment, such as staples, screws or nails, which can become dislodged and vibrate. Of course, it should be realized that the should rest may be made from a one piece, molded plastic material, not requiring any gluing or other fasteners. Ideally, it was discovered that the walls 16, 20, 24, 54, 56, 64, and 66 of the shoulder rest body 8 should be as thin as possible for the most desirable sound quality. However, the body walls must be thick enough to provide rigidity and a sufficient bonding surface such that the bonds will be guaranteed to remain in place over a prolonged period of time. As a compromise, because the thickness of the top and bottom walls 16 and 20 of the shoulder rest body 8 were found to have a more pronounced effect on tonal quality, the preferred fabrication of the two smaller shoulder rest embodiments 100 and 200 is to use a top and bottom wall 16 and 20 having a thickness of about 1/16 inch and side walls 24, 54 and 56 having a thickness of about 1/8 inch. For the "bow tie" shoulder rest 300, however, it is preferred that a wall thickness of 1/8 inch be used all around in order to provide more rigidity and support for the larger-sized shoulder rest body 8.

The shoulder rest of the present invention provides comfortable and adjustable support for a violin or viola that is placed upon a musician's shoulder. Furthermore, by including a sound resonating chamber and supporting feet, the present invention provides such comfort without noticeably interfering with the proper resonance of the instrument or marring the delicate finished surface of the instrument. The shoulder rest of the present invention is simple in its construction, and therefore is inexpensive to manufacture and repair. Moreover, the shoulder rest of the present invention is easy to remove from the instrument and small enough to conveniently store in the instrument case when not in use.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A shoulder rest for use with a stringed musical instrument, the shoulder rest comprising:

a substantially rigid body formed with an interior space defining a resonating chamber;

supporting members mounted on the body and extending therefrom for spacing the body from a musical instrument when the shoulder rest is removably mounted thereon; and a fastener engaging the body, the fastener allowing the rest to be removably mounted on the musical instrument.

2. A shoulder rest as defined by claim 1, wherein the rigid body includes a top wall, a bottom wall situated opposite the top wall, and at least two opposite side walls interposed between the top wall and the bottom wall, the top wall, bottom wall and side walls defining the resonating chamber therebetween.

3. A should rest as defined by claim 2, wherein each of the top wall and bottom wall includes an exterior surface, and wherein the supporting members are mounted on the exterior surface of the top wall and extend therefrom to engage the musical instrument when the shoulder rest is removably mounted thereon.

4. A shoulder rest as defined by claim 3, wherein the shoulder rest further comprises a layer of padding, the layer of padding being secured to the exterior surface of the bottom wall of the body.

5. A shoulder rest as defined by claim 1, wherein the supporting members include individual, hemispherically shaped protrusions.

6. A shoulder rest as defined by claim 5, wherein the hemispherically shaped protrusions are formed from hard rubber.

7. A shoulder rest as defined by claim 1, wherein the supporting members include at least three spaced apart, individual protrusions.

8. A shoulder rest as defined by claim 1, wherein the supporting members include three spaced apart, individual protrusions situated with respect to one another in a triangular formation.

9. A shoulder rest as defined by claim 2, wherein the top wall, bottom wall and the at least two opposite side walls define the body with opposite axial open ends.

10. A shoulder rest as defined by claim 2, wherein the at least two side walls include a first side wall and a second side wall situated opposite the first side wall, and wherein the first and second side walls include mutually diverging portions which define therebetween a flared open end.

11. A shoulder rest as defined by claim 1, wherein the body is configured to have an overall bow tie shape, the body having a central portion and opposite flared end portions extending from the central portion, the central portion having a width which is less than the width of the opposite flared end portions.

12. A shoulder rest as defined by claim 11, wherein each of the opposite flared end portions define an open end.

13. A shoulder rest as defined by claim 1, wherein the rigid body includes a top wall and an opposite bottom wall, each of the top and bottom walls including an exterior surface, the support members being mounted on the exterior surface of the top wall and extending therefrom to engage the musical instrument when the rest is removably mounted thereon, the top wall being at least partially concave so as to allow the rest to be mounted in close proximity to the musical instrument.

14. A shoulder rest as defined by claim 1, wherein the rigid body includes a top wall and an opposite bottom wall, each of the top and bottom walls including an exterior surface, the support members being mounted on the exterior surface of the top wall and extending therefrom to engage the musical instrument when the rest is removably mounted thereon, the bottom wall being at least partially concave to define an arch in the exterior surface thereof so as to engage the shoulder of a player of the musical instrument in the arch of the rest.

15. A method of enhancing the tonal quality of a stringed musical instrument, the musical instrument defining a resonance box, the method comprising the steps of:

(a) forming a shoulder rest defining a resonating chamber; and (b) positioning the shoulder rest in contact with the musical instrument to permit vibrations from the resonance box of the musical instrument to be transferred to the resonating chamber of the shoulder rest when the musical instrument is played.

* * * * *